United States Patent [19]

Giacobbe

[11] Patent Number: 4,872,926

[45] Date of Patent: Oct. 10, 1989

[54] PROCESS FOR HEAT TREATING METALS OR METAL ALLOYS IN A THERMAL PLASMA

[75] Inventor: Frederick Giacobbe, Naperville, Ill.

[73] Assignee: American Air Liquide, New York, N.Y.

[21] Appl. No.: 139,405

[22] Filed: Dec. 30, 1987

[51] Int. Cl.[4] ..... C21D 1/52

[52] U.S. Cl. ..... 148/13.1; 219/121.59; 148/128; 148/16; 148/20.3; 148/151

[58] Field of Search ..... 148/902, 13, 16, 13.1, 148/20.3, 143, 145, 151, 128; 219/121 PY

[56] References Cited

U.S. PATENT DOCUMENTS

| | | | |
|---|---|---|---|
| 2,491,134 | 12/1949 | Robb | 266/96 |
| 3,615,924 | 10/1971 | Swoboda | 148/143 |
| 3,660,630 | 5/1972 | Sunnen | 219/121 P |
| 4,181,845 | 1/1980 | Bolton | 219/8.5 |
| 4,312,685 | 1/1982 | Riedl | 148/146 |
| 4,420,346 | 12/1983 | Belkin et al. | 148/4 |

FOREIGN PATENT DOCUMENTS

| | | | |
|---|---|---|---|
| 665105 | 6/1963 | Canada | 148/152 |
| 3402969 | 8/1984 | Fed. Rep. of Germany . | |
| 1270328 | 11/1986 | Japan | 148/152 |
| 767381 | 1/1957 | United Kingdom . | |
| 887506 | 1/1962 | United Kingdom . | |
| 940018 | 10/1963 | United Kingdom . | |

OTHER PUBLICATIONS

Metals Handbook, vol. 4, Heat Treating, pp. 502–503, ©1981.

*Primary Examiner*—Christopher W. Brody
*Attorney, Agent, or Firm*—Lee C. Robinson, Jr.

[57] ABSTRACT

Workpieces of metal are treated with a high temperature, ambient pressure argon arc plasma system to facilitate surface and through hardening.

The argon flame is directed against the outer surface of the rotating workpiece. The surface temperature is monitored by a non contact I.R. temperature sensor and controlled by varying the inert gas flowrate through the plasma generator and/or varying the electrical power input to the plasma generator.

14 Claims, 2 Drawing Sheets

PROCESS FOR HEAT TREATING METALS OR METAL ALLOYS IN A THERMAL PLASMA

BACKGROUND OF THE INVENTION

The heat treatment of metals and metal alloys is a very old and important industrial processing techology which is necessary for producing a very wide range of useful products. In particular, a large segment of this technology is related to surface and/or through hardening techniques which result in hard, wear and fatigue resistant surfaces superimposed on (in the case of surface hardening) or throughout (in the case of through hardening) a tough but relatively soft plain or alloy steel object. Common methods of currently achieving these results involve the use of either shell hardening, chemical flame hardening, or the use of induction hardening. See for example "Principle of Heat Treatment" by Georges KRAUS—ASM—1980—Chapter 10—or "Practical Heat Treating" by Howard E. Boyer—ASM—1984—Chapter 11.

Shell hardening is typically used in order to harden only the surface layers of a particular metal or metal alloy object. The specific object is usually immersed in a heating medium such as molten lead or a molten salt bath. This step is followed by quenching which produces a hard outer layer. This method of hardening is limited largely by part design (i.e. the entire part must be heated) and inherent limitations in the heating bath temperatures. These limitations prevent extremely rapid and localized heating in specific zones or areas of an object to be heat treated.

Flame hardening involves the use of a flame produced by a chemical reaction between an appropriate fuel gas and oxygen. Commonly used fuel gases are hydrogen or acetylene. Using this technique, objects to be selectively hardened are heated in the flame for an appropriate period of time, then rapidly quenched. The main limitation of this technique is that the chemical flame temperature limits the rate of heat transfer to the metal object and thus the rate of sample temperature increase is limited. This effect tends to allow conduction to overheat some specimen sections which are adjacent to the heat treated zone.

When the induction process is employed, the unhardened metal or metal alloy specimen is indirectly heated due to currents induced in the specimen by an external electromagnetic induction coil. There are a number of significant disadvantages associated with this technology. For example, localized temperature control is difficult to achieve using the induction hardening technique, especially on parts with sharp edges or varying thicknesses.

Since induction heating depends on currents induced within specific metallic specimens, some objects, (due to their geometrical shapes) cannot be hardened effectively using this technique. In addition, different shaped or sized objects each require their own specially designed induction coils so that the induction hardening process will be optimized. In some instances, the costs associated with the design and fabrication of these special induction coils can be prohibitive, especially if the objects which must be hardened are not manufactured in large quantities.

SUMMARY AND OBJECTS OF THE INVENTION

Many of the limitations noted above an be overcome through the use of an appropriately designed and controlled thermal plasma heat treating system. The present invention, disclosed herein, describes such a system which can be used for heat treating a large variety of specific metal and/or metal alloy objects. This thermal plasma system employs an ambient pressure argon or nitrogen plasma "flame" to facilitate hardening the surface or through hardening specific metal and/or metal alloy specimens. This system has a number of unique advantages over the methods described above as well as advantages over conventional furnace hardening techniques.

One of these advantages involves the fact that a suitably designed and controlled thermal plasma system can be used to obtain very precise and localized temperature control in many types of metallic objects which must be heat treated. Another advantage of this technique involves extremely rapid specimen heating rates due to the extremely high temperatures which can be produced within the plasma "flame". For example, plasma "flame" temperatures exceeding 10,000° C. are easily achieved but typical molten salt bath temperatures or chemical flame temperatures rarely exceed 3,300° C. Due to the very high temperatures, which can be achieved in a plasma "flame", metal or metal alloy objects can be heated extremely rapidly in a plasma "flame". However, overheating and associated localized melting phenomena can be completely eliminated by reducing the plasma "flame" temperature as soon as the metal or metal alloy object being heated reaches its soak temperature. This adjustment is readily made by either manually or automatically adjusting the electrical power input to the plasma "flame" generator. This soaking temperature will be preferably maintained between about 600° C. and 1000° C.

A very small number of plasma system modifications can also be employed in order to facilitate the heat treatment of a large number of specimens having a wide range of different geometrical shapes and sizes. In addition, multiple plasma systems may be employed simultaneously in order to efficiently heat treat relatively wide bands of material on large specimens. When multiple systems are used, varying thicknesses of material, within the same specimen, can be independently and simultaneously heated under the same or differing temperature conditions. In general, extremely rapid and controlled heating (possible only with a thermal plasma system) followed by appropriate quenching and/or annealing or tempering steps, permits the production of a wide range of useful metallic mechanical parts which are difficult, if not impossible, to efficiently heat treat using any other technique. Quenching of the workpieces may be performed immediately, as soon as the plasma flame is extinguished, e.g. by spraying a liquid such as water or a liquefied gas, such as liquid nitrogen, argon or carbon dioxide while the workpiece is still rotating and/or translating on its support. Quenching may also be accomplished after stopping rotation and/or translation of said workpiece by immersion of the same in a liquid.

The process according to the invention provides a means for heat treating metals and/or metal allloys in a plasma "flame" in oder to harden any predetermined depth of the specimen or to harden completely through the specimen. An additional feature of this process is that it can be used to heat suitable metallic specimens very rapidly, thereby minimizing detrimental heating of adjacent regions in the same specimen due to conduction. The process also is capable of producing excellent temperature control in heated specimens as well as excellent depth control in the hardened layer. In addition, this process is relatively easy to adapt to various shapes and sizes of workpieces and is capable of providing excellent microstructural properties in selectively hardened areas of the workpiece.

BRIEF DESCRIPTION OF THE INVENTION

The process according to the invention involves the use of a high temperature, ambient pressure, thermal plasma system which can be used to facilitate surface and through hardening in specific metal alloy test specimens. The apparatus of the invention can be adapted to create a very high tempeature thermal plasma within a flowing argon gas stream. However, other pure gases or mixtures of gases can be used in place of argon. During the use of this system, a high temperature argon plasma "flame" is directed against the outer surface of a rotating metal alloy test specimen. The surface temperature of the test specimen is monitored by a non-contact infrared temperature sensor. The temperature of the test specimen is controlled by varying the inert gas flow rate through the plasma generator and/or varying the electrical power input to the plasma generator. These means of temperature monitoring and control can be used to obtain very precise regulation over specimen temperatures during the heating and/or soaking phase of any specific heat treating operation.

According to a preferred embodiment, the invention provides a method for heat treating a workpiece of metal, in a plasma flame generated by plasma generating means, comprising the steps of:

moving the workpiece in the plasma flame path, rotating the workpiece at a speed fast enough so that significant cooling does not occur between the position where said workpiece is heated in said plasma flame and the position required to measure the surface temperature by a non contact surface temperature measurement means, igniting the plasma generating means in order to generate the plasma flame, controlling the plasma flame temperature and thus the surface workpiece temperature by means of said non contact surface temperature measurement means, in order to maintain the desired rate of sample heating and the desired soaking temperature of the workpiece, extinguishing the plasma flame, quenching the workpiece.

DETAILED DESCRIPTION OF THE INVENTION

Figure 1:
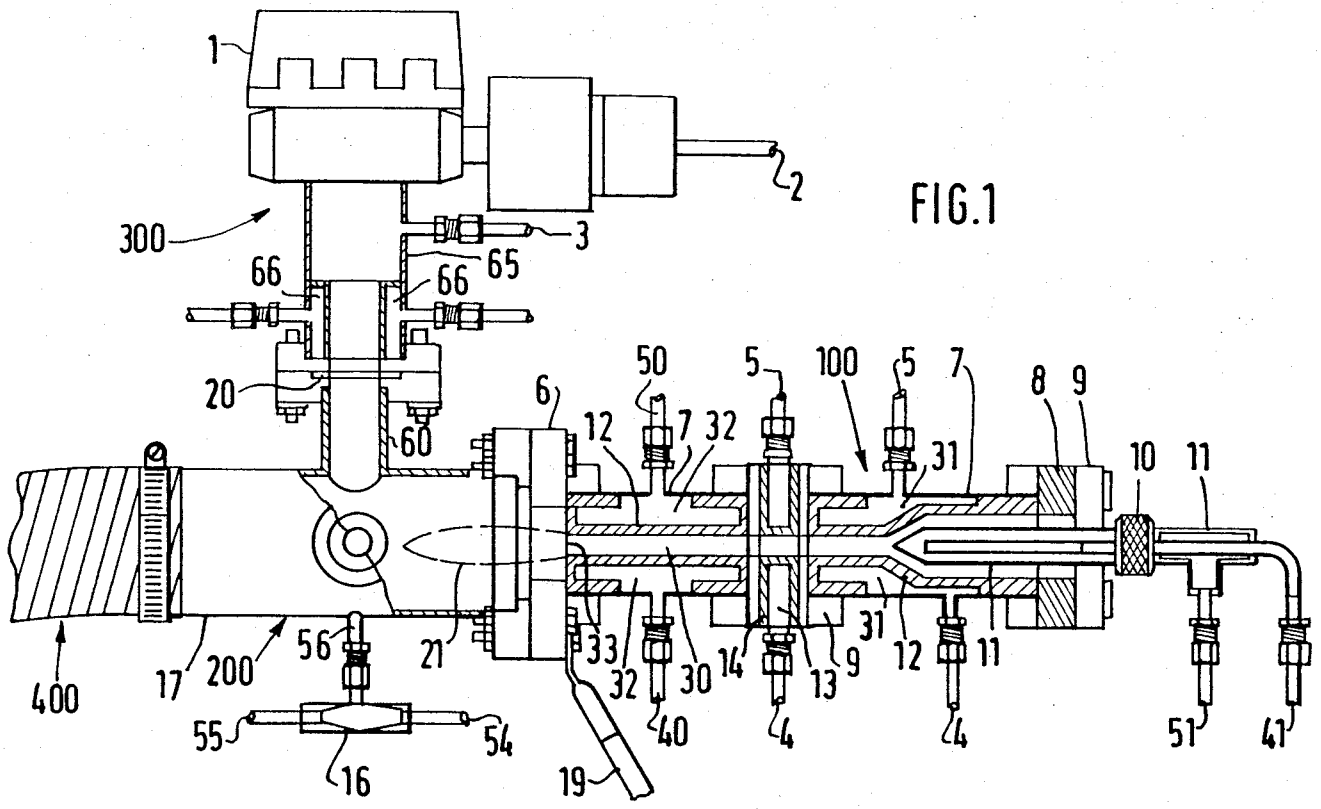
FIG. 1 is a schematic side view with a partial cross section of the thermal plasma processing apparatus for use in surface and through hardening according to the invention.

FIG. 1 illustrates a thermal plasma processing apparatus according to the invention, comprising a plasma flame generator means 100, a heat treating enclosure 200, an Infrared temperature sensor means 300 and a gas venting means 400. The plasma flame generator means 100 comprises a cathode enclosure 7 in which the cathode 11 is placed and maintained by a support flange 9 which is connected through the plasma gas injection ring 8 to the enclosure 7. A plasma gas inlet is provided in the ring 8, which is not represented on the drawing. Support means 12 coaxiallly aligned with the enclosure 7 determines an internal channel 30 coaxially aligned with the cathode 11 in which the plasma gas flows and external channels 31 and 32 respectively connected to water inlets 4,40 and water outlets 5,50 to cool said internal channel 30. Water inlet 41 and outlet 51 are also provided to internally cool the cathode 11.

An adaptator flange 6 makes the connection between the output 33 of said channel 30 and the heat treating enclosure 200, said flange being also connected to the anode cable 15 and being thus the high voltage anode. The plasma flame 21 is generated between the cathode 11 and the anode 6 and extends up to the workpiece 19 to be treated which is represented as a hollow specimen. This specimen is secured rotatably to support rings 18, 38 and thus placed in the plasme flame path.

The enclosure 200 comprises a conduit 56 connected to a quench-drain valve 16 which in turn is connected to a quench fluid conduit 54,55, in order to allow quenching of the workpieces immediately after extinguishing the flame or later.

I.R. temperature measurement means are located above the specimen, about in front of the conduit 56. The I.R. temperature sensor 1 is connected to the remote power supply (not represented on the figure) by the cable 2. A hollow cylindrical sheath 60 is connected to the enclosur 200 on one end and to a second hollow cylindrical sheath 65 on the other end which is, inturn, connected to the I.R. sensor 1. A water jacket 66 is provided between the first and second sheath 60, 65 to cool the gas between the enclosure 200 and the I.R. sensor 1.

Figure 2:
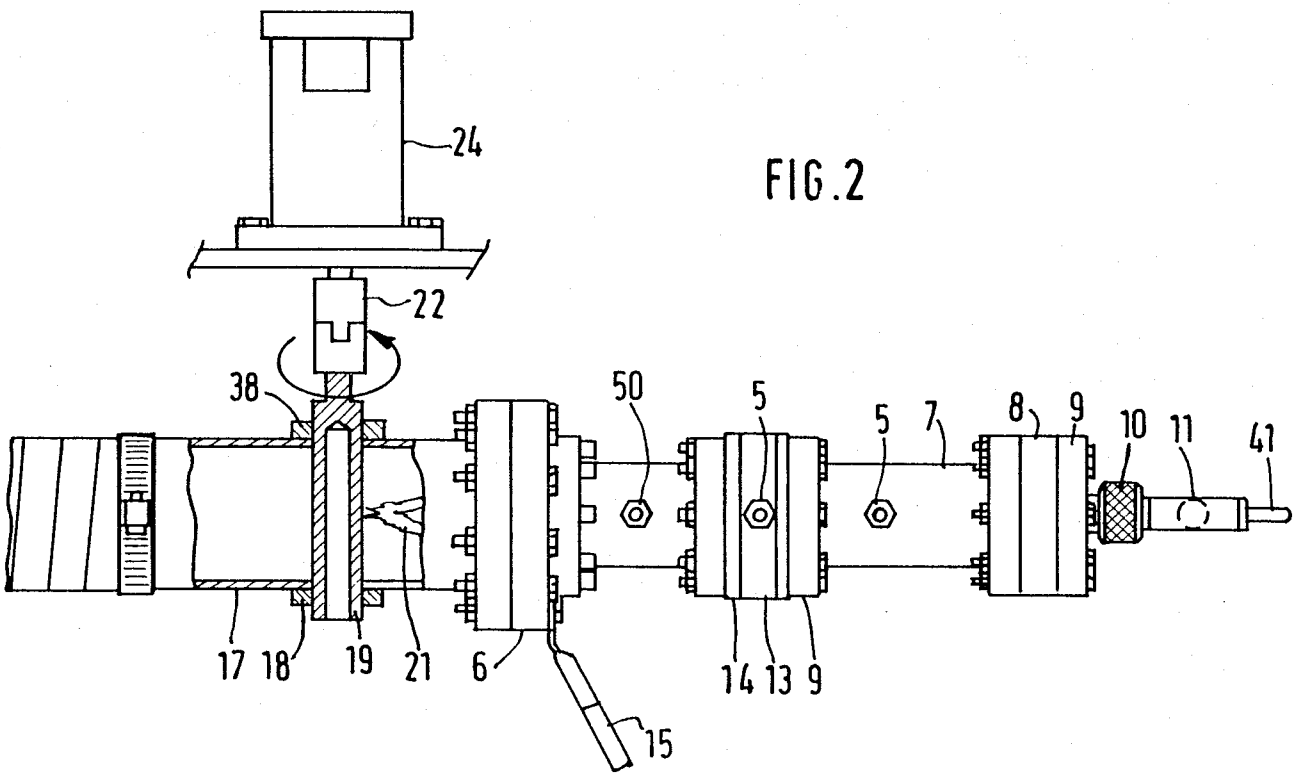
FIG. 2 is a top view with partial cross section of the apparatus according to FIG. 1.

FIG. 2 is the top view of the apparatus of FIG. 1 wherein the same references indicate the same devices.

The workpiece 19 (or specimen) rotates between two support rings 18, 38 and is attached through the coupling means 22 to the variable speed D.C. motor 24, comprising means (not represented on the drawing) to vary the speed of rotation of said specimen according to the requirement of the process.

EXAMPLES

The apparatus and process of the invention disclosed herein were tested on a number of actual metal alloy specimens. These specimens were all fabricated from E52100 steel because this type of steel can be effectively hardened by the induction process.

EXAMPLE 1

Initial test specimens were machined from hot finished, spheridized-annealed lengths of 1.27 cm o.d. round stock. Each of these test specimens were cut into 15.2 cm lengths. Approximately 0.02 cm of material was also machined off the surface of these specimens in order to remove microstructural imperfections due to the manufacturing process used to form this material. A number of these specimens were heat treated in a pure argon plasma "flame" produced using the equipment illustrated in FIGS. 1 and 2. However, the specimen support assembly was modified to hold the 1.27 cm o.d. rods machined for these tests.

During this evaluation, the 1.27 cm o.d test rods were rotated at approximately 10 rev/sec in order to insure uniform specimen heating. Pure argon, at a flow rate of approximately 100 SLPM (standard liters per min) was used as the plasma gas. An additional argon gas flow rate of about 12 SLPM was used to purge the optical path between the infra-red sensor and the surface of the rotating test specimen. Electrical power requirements were dictated by the plasma gas flow rates, system geometry, heat losses to the surroundings and cooling water, and the rapid heating rates chosen for this set of tests. The initial plasma input power requirement was about 10 Kw (100 amps at 100 volts). Under these conditions, the 1.27 cm o.d. alloy steel samples exhibited an almost linear temperature increase from ambient temperatures to 850°±5° C. within approximately 30 sec. The test samples were maintained or soaked at 850°±5° C. for varying lengths of time by manually decreasing the current input sustaining the plasma "flame". The power requirement during the soaking phase was about 9 Kw (90 amps at 100 volts). All of this electrical power was needed to hold the sample temperature at 850°±5° C. and simultaneously compensate for all of the inherent heat losses associated with the experimental apparatus configuration and operating parameters. After each soaking period the plasma power supply was shut off and the hot rotating test specimens were rapidly quenched with water. Test results obtained from two of the specimens treated as outlined above are listed in Table 1. It may be seen that excellent and uniform through hardening was produced in both of these specimens. The hardness throughout the heat affected zones in both of these specimens was above 60 on the Rockwell C Scale. The microstructure throughout the heat affected zones was excellent and all physical properties were equivalent to or better than those obtained using an induction type of hardening process.

EXAMPLE 2

Larger sized specimens of the same steel were machined from 2.54 cm o.d. solid round stock. These specimens were also hardened using the thermal plasma system described herein. Except for the electrical power input used during initial sample heating stages, most operating conditions used during the treatment of these specimens were nearly identical to the operating conditions used for heat treating the 1.27 cm o.d. specimens described above. However, the 2.54 cm o.d. specimens were heated up to and soaked at 870°±5° C. These specimens also took longer to reach the soak temperature due to their larger mass. For example, one of these samples was heated from 300° to 870° C. in about 45 sec. Another identical specimen was heated form 370° to 870° C. in about 81 sec. The main reason for the significant difference in these heating rates was related to the fact that differing plasma electrical power inputs were used during the initial heating stages of these samples. Test results obtained from two of these solid 2.54 cm o.d. specimens are listed in Table 2. It may be seen that excellent hardening througout the heat treated zones were achieved in both of these samples. However, through hardening was not achieved in the sample soaked at 870°±5° C. for only 10 sec but through hardening was achieved in the other sample. This demonstrates clearly that the variable of time may be used to control the depth of the hardened layer when this process is properly applied to appropriate metal alloy specimens. This is a significant feature of this process.

EXAMPLE 3

An additional set of 2.54 cm o.d., hollow, alloy steel specimens were machined and tested using the apparatus and process of the invention. These specimens were also machined from the same bar of E52100 steel used to make the solid specimens. The hollow center section of these rods had an inside diameter (I.D.) of 1.27 cm. The length of this central hollow section extended well beyond either side of the centrally heated zone exposed to the plasma heating "flame". FIGS. 1 and 2 also give a good representation of the apparatus configuration used to treat these samples. Operating conditions were also almost identical to those described above except for the plasma electrical power input during the initial heating stages of these samples. Due mainly to these differences in plasma electrical power input, these samples were heated from room temperatures to 870°±5° C. in about 100 sec. Test results obtained from two of these hollow test specimens are listed in Table 3. These test results, demonstrate that complete through hardening can be obtained within a selected and well defined region in hollow specimens. The fact that surrounding regions can remain relatively soft and tough is another significant advantage associated with this process.

TABLE 1

PLASMA HEAT TREATING RESULTS USING SOLID 1.27 cm O.D. ALLOY STEEL SPECIMENS

| | SAMPLE 1 | SAMPLE 2 |
|---|---|---|
| Soaking time at 850 ± 5° C. (sec) | 10 | 30 |
| Length of Hardened Outer Surface Zone (cm) | 1.97 | 1.97 |
| Length of Hardened Zone at Center of specimen (cm) | 1.76 | 1.84 |
| Hardness Throughout Heat Treated Zone (RC Scale) | >60 | >60 |
| Hardness Outside of Heat Treated Zone (RC Scale) | <10 | <10 |

TABLE 2

PLASMA HEAT TREATING RESULTS USING SOLID 2.54 cm O.D. ALLOY STEEL SPECIMENS

| | SAMPLE 1 | SAMPLE 2 |
|---|---|---|
| Soaking time at 850 ± 5° C. (sec) | 10 | 300 |
| Length of Hardened Outer Surface Zone (cm) | 2.2 | 6.0 |
| Length of Hardened Zone at Center of specimen (cm) | 0.0 | 4.5 |
| Depth of Hardened Layer at Center of Heated Zone (cm) | 0.5 | 1.3 |
| Hardness Throughout Heat Treated Zone (RC Scale) | >60 | >60 |
| Hardness Outside of Heat Treated Zone (RC Scale) | <10 | <10 |

TABLE 3

PLASMA HEAT TREATING RESULTS USING SOLID 2.54 cm O.D. ALLOY STEEL SPECIMENS

| | SAMPLE 1 | SAMPLE 2 |
|---|---|---|
| Soaking time at 850 ± 5° C. (sec) | 10 | 60 |
| Length of Hardened Outer Surface Zone (cm) | 1.7 | 2.1 |
| Length of Hardened Zone at I.D. of specimen (cm) | 1.7 | 2.1 |
| Hardness Throughout Heat Treated Zone (RC Scale) | >55 | >60 |
| Hardness Outside of Heat Treated | <10 | <10 |

TABLE 3-continued

| PLASMA HEAT TREATING RESULTS USING SOLID 2.54 cm O.D. ALLOY STEEL SPECIMENS | | |
|---|---|---|
| | SAMPLE 1 | SAMPLE 2 |
| Zone (RC Scale) | | |

I claim:

1. A method for localized heat treating of a workpiece of metal to a predetermined depth in a plasma flame generated by plasma generating means, comprising the steps of:

directing inert gas through the plasma generating means;

igniting the inert gas in the plasma generating means to produce a plasma flame having a temperature exceeding 10,000° C.;

moving the workpiece into the plasma flame path;

rotating the workpiece at a speed fast enough so that significant cooling does not occur between the position where said workpiece is heated in said plasma flame and the position in which the surface temperature of the workpiece is monitored;

monitoring the surface temperature of said workpiece by noncontact surface temperature measurement means;

varying the inert gas flow rate through the plasma generating means, in response to the monitored surface temperature, to thereby control the temperature of the plasma flame and thus the workpiece surface temperature in order to maintain a predetermined heating rate and to rapidly reach the desired soaking temperature for the workpiece;

extinguishing the plasma flame; and quenching the workpiece.

2. A method according to claim 1, wherein said non contact surface temperature measurement means are I.R. means.

3. A method according to claim 1, wherein the desired soaking temperature is maintained between about 600° C. and 1000° C.

4. A method according to claim 1, further comprising a step of translating the workpiece along the rotational axis.

5. A method according to claim 4, wherein it further comprises a step of varying the speed of translation of the workpiece according to its geometry in order to treat about the same depth all over the workpiece.

6. A method according to claim 1 or 5, wherein it further comprises a step of varying the speed of rotation of the workpiece according to its geometry in order to treat about the same depth all over the workpiece.

7. A method according to claim 1, further comprising a step of simultaneously heat-treating different zones of the same workpiece with a plurality of plasma generating means, each being associated with non contact surface temperature means.

8. A method according to claim 7, wherein each of the different zones is treated at a different temperature from the others.

9. A method according to claim 7, wherein each of the different zones is treated at a different thickness from the others.

10. A method according to claim 15, wherein the gas is hydrogen, helium, neon, argon, krypton, zenon, radon, nitrogen, oxygen, carbon dioxide or a mixture thereof.

11. A method according to claim 1, wherein said quenching is made immediately after the flame has been extinguished.

12. A method according to claim 1, wherein said quenching step is made by spraying a cooling fluid onto the surface of the workpiece.

13. A method according to claim 12, wherein said quenching is made while the workpiece is still rotating.

14. A method according to claim 12, wherein said quenching is made by spraying a liquefied gas onto the surface of said workpiece.

* * * * *